US006050695A

United States Patent [19]

Fromm

[11] Patent Number: 6,050,695

[45] Date of Patent: Apr. 18, 2000

[54] NOVELTY JEWELRY

[76] Inventor: Wayne G. Fromm, 3500 Bathurst, Toronto, Ontario, Canada, M6A 2C6

[21] Appl. No.: 09/071,304

[22] Filed: May 1, 1998

[51] Int. Cl.[7] ..... F21L 15/08; F21V 33/00

[52] U.S. Cl. ..... 362/104; 362/86; 362/806; 63/15

[58] Field of Search ..... 362/395, 104, 362/806, 249, 86; 63/15, 1.1

[56] References Cited

U.S. PATENT DOCUMENTS

| | | | |
|---|---|---|---|
| D. 254,537 | 3/1980 | Abelson . | |
| D. 254,606 | 4/1980 | Abelson . | |
| 1,758,447 | 5/1930 | Liebs . | |
| 2,405,384 | 8/1946 | White | 362/104 |
| 3,392,276 | 7/1968 | Roman . | |
| 3,790,775 | 2/1974 | Rosenblatt | 362/104 |
| 3,866,035 | 2/1975 | Richey, Jr. | 362/104 |
| 4,076,976 | 2/1978 | Fenton | 362/104 |
| 4,148,372 | 4/1979 | Schroeder . | |
| 5,201,578 | 4/1993 | Westmoland | 362/104 |
| 5,323,300 | 6/1994 | McCrary . | |
| 5,519,591 | 5/1996 | McCrary . | |
| 5,622,062 | 4/1997 | Gong-Hwa | 63/15 |
| 5,653,524 | 8/1997 | Gray . | |

*Primary Examiner*—Thomas M. Sember
*Attorney, Agent, or Firm*—John C. Thompson

[57] ABSTRACT

Novelty jewelry in the form of sets of jewelry items which may be sold in pairs, at least one jewelry item being provided with an electrical display which will become operational when the two jewelry items are placed together. In one embodiment the novelty jewelry comprises first and second finger rings (14), at least one of which is provided with an electrical display such as a lamp (18) and a normally open electrical circuit interconnected with the electrical display. At least one of the first and second jewelry items is provided with a battery (24), or other source of electrical current. Operation of the electrical display is initiated by bringing the two jewelry items together.

15 Claims, 3 Drawing Sheets

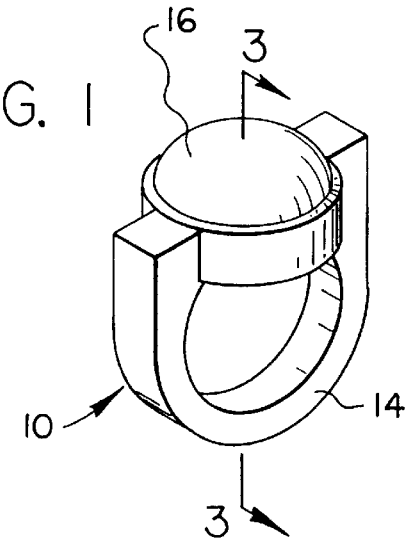
FIG. 1
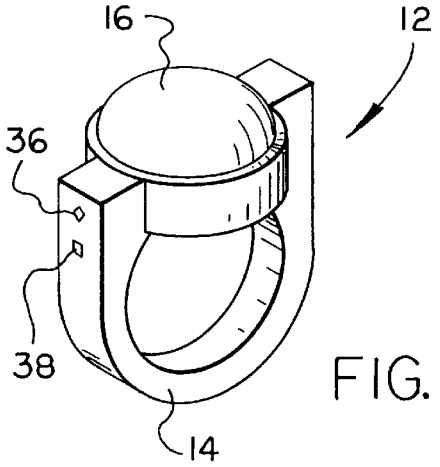
FIG. 2
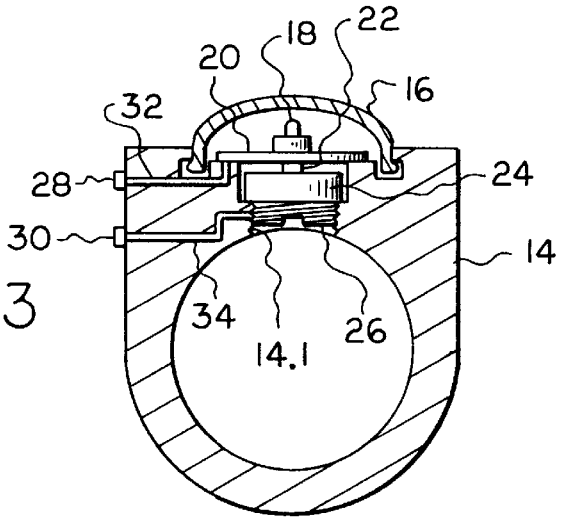
FIG. 3
FIG. 4
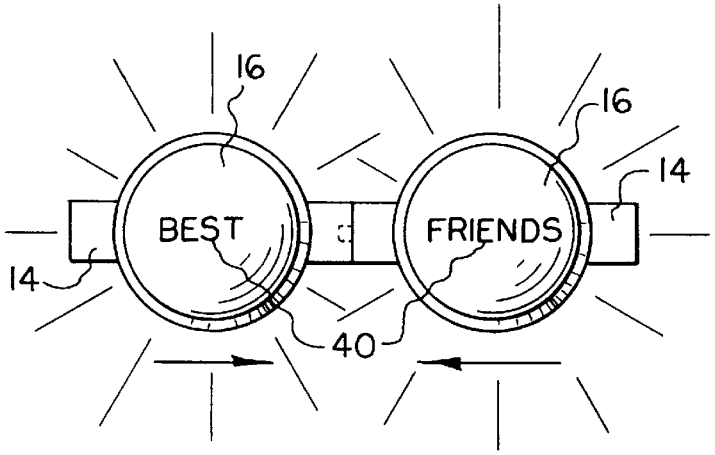
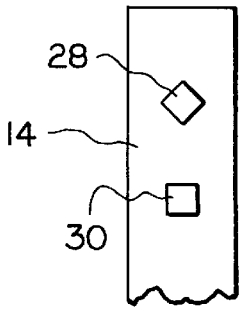
FIG. 3A

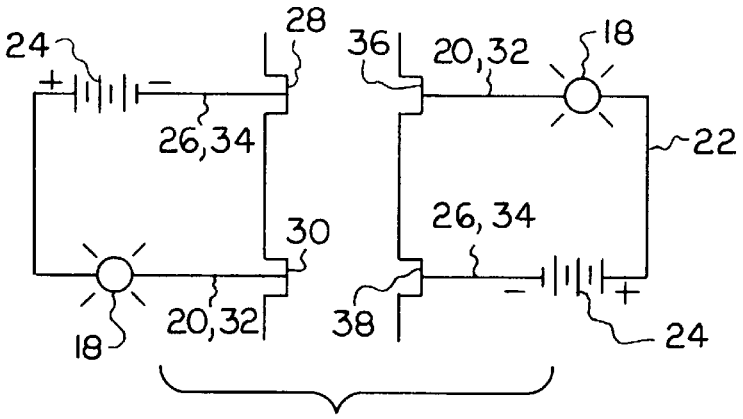
FIG. 4A
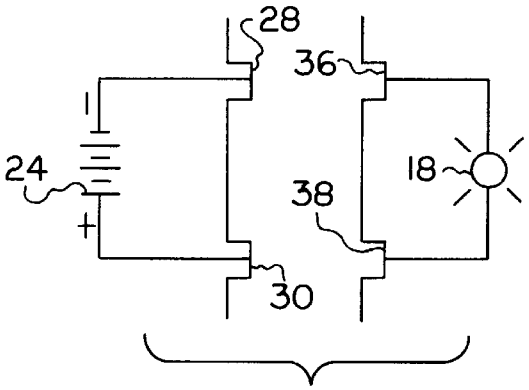
FIG. 4B
FIG. 4C
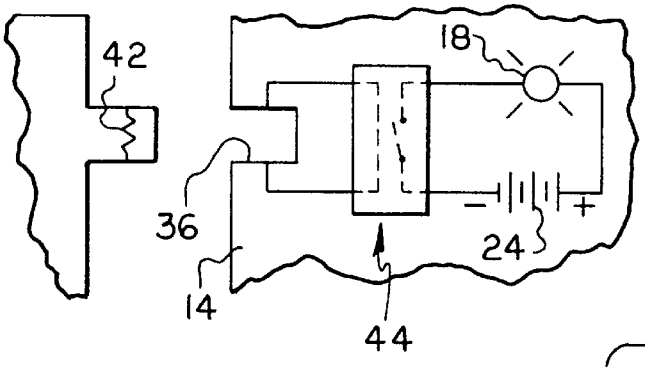
FIG. 10
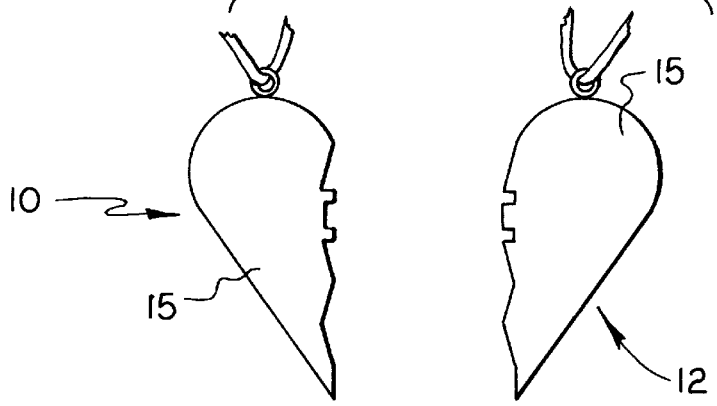

NOVELTY JEWELRY

TECHNICAL FIELD

The present invention relates generally to novelty jewelry, and more particularly to sets of jewelry which may be sold in pairs, each jewelry item being provided with an electrical display which will become operational when the two jewelry items are placed together.

BACKGROUND OF THE INVENTION

There is a large market for children,s friendship rings and necklaces. Such items will cooperate with each other when they are placed together. A prior art example of rings which cooperate with each other when brought together is shown in U.S. Pat. No. 1,758,447 where two rings may be joined together to show a message, which message is not readily visible when the rings are separated. A similar concept is shown in U.S. design Pat. Nos. 254,537 and 254,606. While this prior art illustrates two rings which may cooperate with each other, these rings are not provided with electrical displays. However, it is known in the prior art that individual rings may be provided with electrical displays, see for example U.S. Pat. Nos. 3,392,276; 5,323,300; 5,519,591; 5,622,062; and 5,653,524. However, all illuminated jewelry known to applicant operates by itself and does not require the presence of other jewelry to initiate its operation.

OBJECTS AND SUMMARY OF THE INVENTION

It is an object of this invention to provide novelty jewelry consisting of two jewelry items, at least one of which is provided with an electrical display and which will require the presence of another matching jewelry item to initiate the operation of the electrical display.

More particularly, it is an object of the present invention to provide novelty jewelry comprising first and second jewelry items, at least one of which is provided with an electrical display and a normally open electrical circuit interconnected with the electrical display. At least one of the first and second jewelry items is provided with a battery or other source of electrical current. Operation of the electrical display is initiated by bringing the two jewelry items together.

The foregoing objects and other objects and advantages of this invention will become more apparent after a consideration of the following description taken in conjunction with the accompanying drawings in which preferred forms of the present invention are illustrated.

BRIEF DESCRIPTION OF THE DRAWINGS

FIGS. 1 and 2 are views of a pair of jewelry items of this invention, the jewelry items being in the form of finger rings.

FIG. 3 is a cross-sectional view of the finger ring shown in FIG. 1, this view being taken generally along the line 3—3 in FIG. 1.

FIG. 3A is an enlarged side elevational view of a portion of the ring shown in FIG. 3.

FIG. 4 shows the two finger rings of FIGS. 1 and 2 joined together to cause translucent elements to become illuminated, each of the translucent elements being provided with a message.

FIG. 4A is an illustration of electrical circuits which may be used in the finger rings shown in FIGS. 1–4, wherein each of the finger rings is provided with an electrical display in the form of a light and it's own source of electrical current in the form of a battery.

FIG. 4B shows an alternate circuit wherein one finger ring is provided with an electrical display in the form of a light, and the other finger ring is provided with a source of electrical current.

FIG. 4C is another alternate circuit illustrating a second jewelry item provided with a key having an electrical component which is used to close the normally open circuit of a first jewelry item.

FIG. 10 is a pair of jewelry items in the form of two lockets.

DETAILED DESCRIPTION

Figure 5:
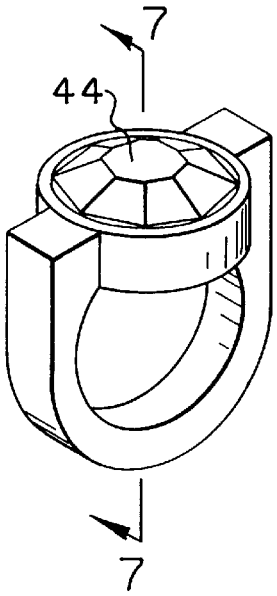
FIGS. 5 and 6 show an alternate design of a pair of finger ring wherein each translucent element has been replaced with an element which resembles a colored stone.
Figure 6:
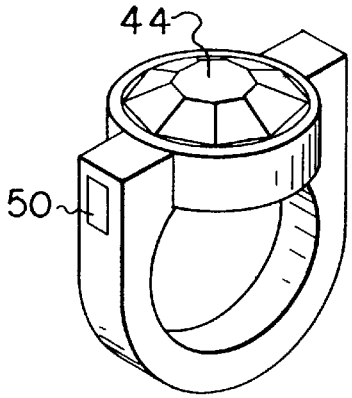

The novelty jewelry of the present invention will typically be sold in pairs and will include a first jewelry item indicated generally at 10, and a second jewelry item indicated generally at 12. While the jewelry items may be finger rings 14 as indicated in FIGS. 1–8, the novelty jewelry may take other forms. For example, the novelty jewelry may take the form of two lockets 15 as shown in FIG. 10. While various embodiments are envisioned, each pair of jewelry items will include at least one electrical display, at least one source of electrical current, and means to cause current to flow through the electrical device when the two jewelry items are brought together. This can probably best be understood from a consideration of the first embodiment which is illustrated in FIGS. 1–4A.

In the first embodiment each of the jewelry items consists of a finger ring 14. In this embodiment each finger ring includes a translucent element 16 which is snapped into a suitable recess on the ring. The translucent elements may be of matching colors. Each translucent element is mounted above an electrical display in the form of a light source 18 which may be an LED. As can best be seen from FIG. 4, the translucent elements may be provided with a message. The message would not be normally visible but will become visible when the light sources 18 are operated. Instead of a message the translucent elements may be provided with images, or they may be provided with both images and messages. The LED is mounted on a plate 20, one of the leads of the LED being in contact with an outer annular conductive portion of the plate 20. The plate is secured to the ring 14 in any conventional manner. The plate carries a conductive button 22 on its lower surface to which the other lead light source is connected, the conductive button 22 being held in contact with the cathode of a button type battery 24. The battery is held in place by a metallic screw plug 26 which is received within a threaded aperture 14.1 on the finger ring 14. It should be noted that when the plug is tightened, it will bear against the anode of the battery and will force the cathode into contact with the conductive button 22.

One of the rings 14 is provided with two male contacts (or keys) 28 and 30 of special cross section, as can be seen from FIG. 3A. The male contact 28 is interconnected with the annular conductive portion of the plate 20 via a suitable lead 32, and the other male contact 30 is connected with the anode of the battery via the metallic plug 26 and a further lead 34. The other finger ring is provided with suitable female contacts (or keyholes) 36 and 38 which are also suitably connected to a light emitting diode in the finger ring in a fashion similar to the manner in which the male contacts are connected.

As can best be appreciated from FIG. 4A, when the male contacts 28 and 30 are properly inserted into the female contacts 36 and 38, a circuit will be completed through the batteries 24 and the light 18 in each of the rings, causing the lamp to become operational. When the contacts 28, 30 and 36, 38 are separated, the circuits will resume their normally open states and no more current will flow through the electrical displays. Stated another way, the contacts 28, 30 and 36, 38 will close the normally open circuit in each of the rings when they are brought into juxtapositioned relationship with each other. Because, in the preferred embodiment, the male and female contacts have specific cross sections suitable for each other, only matching finger rings can be used together to close the normally open circuits, causing the two finger rings to become illuminated.

A first alternate circuit is illustrated in FIG. 4B. In this circuit, the first finger ring 14 is provided with a light source and no battery, and the second finger ring is provided with a battery but no light source. When the two finger rings are brought together, the second finger ring will power the first finger ring to cause operation of the light. This form of circuit has particular application when the first finger ring is a doll's size finger ring, and the second finger ring is a child's size ring. This will permit the child to cause the doll size ring to become lighted.

In the designs shown in FIGS. 1–4A, it is envisioned that the contact keys will be of special cross section. It is also possible to achieve the same result by providing the male key with a suitable electrical component 42, such as a resistor, as shown in FIG. 4C. The other ring which has the keyhole is provided with a sensing circuit indicated generally at 44, which sensing circuit may include a suitable circuit of the type disclosed in U.S. Pat. No. 4,148,372 so that the circuit through the electrical component or display 18 will remain open unless a suitable resistor is inserted into the keyhole.

Figure 7:
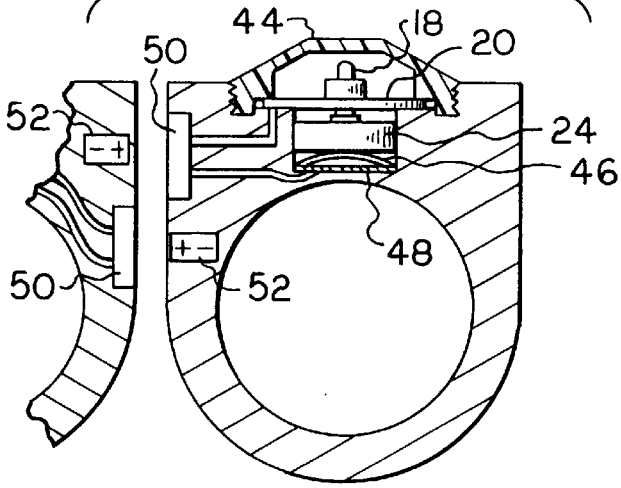
FIG. 7 is a cross-sectional view taken generally along the line 7—7 in FIG. 5, and showing yet another circuit for causing operation of the electrical display device.
Figure 8:
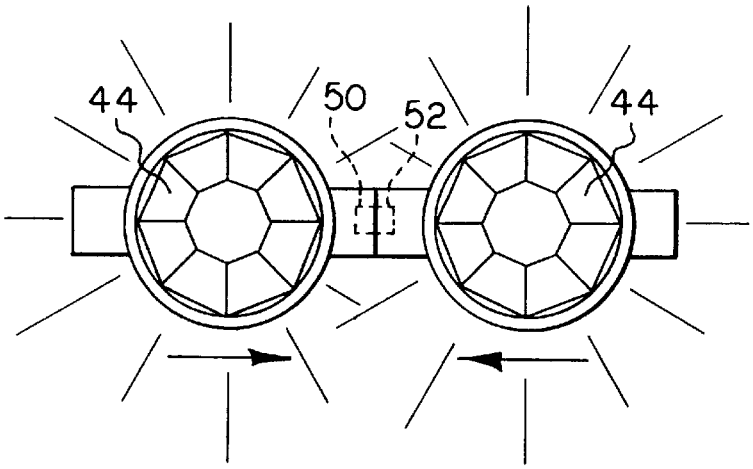
FIG. 8 shows how the two rings of FIGS. 5 and 6 may be placed in contact with each other to cause illumination of the colored stones.

With reference now to FIGS. 5–8, still further embodiments of the finger rings are shown. In these embodiments, the translucent element 16, which snaps into place in the finger ring of FIGS. 1–4, has been replaced with a plastic element 44 which screws into the ring, the plastic element resembling a stone. In the design shown in FIGS. 5–8, the plastic elements or stones 44 of each pair of rings may be of suitable matching colors. When the stone 44 is screwed into place in a ring, it will capture the associated plate 20 and force it against a shoulder of the ring. This will also force the conductive button 22 into contact with the cathode on the button type battery. This also causes the button type battery to bear against a metallic spring 46 on a conductive wafer 48. Each of the two matching rings is provided with magnetic switch 50 and a suitable magnet 52. When the rings are brought together, as indicated in FIG. 7, the magnets 52 will cause the magnetic switches 50 to close initiating current flow from the battery 24 through the now closed switch 50 and lamp 18. It should be noted that in this design the lamp 18 is held in place in the ring in the same manner that the bulb of many flashlights is held in place, so that the lamp in turn holds the battery in place against the spring.

Figure 9:
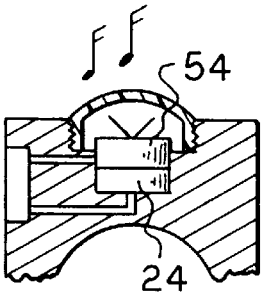
FIG. 9 is a partial sectional view through a finger ring illustrating an alternate electrical display.

With reference now to FIG. 9, it can be seen that other forms of electrical displays may be provided in the jewelry items of this invention. For example, a device 54 may be provided which emits sound when the magnetic switch 50 is closed. While the sound emitting device 54 is shown with a magnetic switch, other normally open circuits may be employed which, when closed, will cause the sound emitting device to function.

Finally, with reference to FIG. 10, it can be seen that the present invention may be embodied in other forms of jewelry items. Thus, for example, two half lockets 15 are illustrated in this figure. The lockets when brought together will cause suitable electrical devices (not shown) within the lockets to become operational.

While preferred forms of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. Novelty jewelry comprising:

a first jewelry item provided with an electrical display;

a second jewelry item;

at least one of the first and second jewelry items being provided with a source of electrical current;

wherein the first jewelry item is provided with a normally open circuit interconnecting the electrical display with the source of electrical current;

wherein the second jewelry item is provided with means to close the normally open circuit of the first jewelry item to cause operation of the electrical display of the first jewelry item when the second jewelry item is positioned adjacent the first jewelry item; and wherein the first jewelry item is a first finger ring and the second jewelry item is a second finger ring.

2. The novelty jewelry as set forth in claim 1 wherein the second jewelry item is also provided with an electrical display which may be operated when the electrical display of the first jewelry item is operated.

3. The novelty jewelry as set forth in claim 1 wherein the second jewelry item is also provided with an electrical display, and a normally open circuit interconnecting the electrical display and the source of electrical current; wherein each of the jewelry items is provided with a source of electrical current; and wherein the first jewelry item is provided with means to close the normally open circuit of the second jewelry item to cause operation of the electrical display of the second jewelry item when the first jewelry item is positioned adjacent the second jewelry item.

4. The novelty jewelry as set forth in claim 3 wherein the means to close the normally open circuits of the first and second jewelry items are matching contacts in each of the jewelry items, a circuit being completed through the two jewelry items when they are placed in contact with each other so that both power sources will be connected in series and be capable of operating both electrical displays.

5. The novelty jewelry as set forth in claim 1 wherein the first jewelry item includes one or more keyholes, and wherein the means to close the normally open circuit of the first jewelry item, which is carried by the second jewelry item, includes one or more keys which may be introduced into the one or more keyholes of the first jewelry item to close the normally open circuit of the first jewelry item.

6. The novelty jewelry as set forth in claim 5 wherein each key has a special shape so that it can only be received in a matching keyhole.

7. The novelty jewelry as set forth in claim 5 wherein each key is provided with a suitable electrical component, and wherein the normally open electrical circuit is provided with means to initiate operation only when a key having the suitable electrical component is inserted within a matching keyhole.

8. The novelty jewelry as set forth in claim 1 wherein the electrical display is a source of music.

9. The novelty jewelry as set forth in claim 1 wherein the electrical display is a source of light.

10. The novelty jewelry as set forth in claim 1 wherein the first finger ring is a dolls size finger ring, and wherein the second finger ring is provided with a source of electrical current, the second finger ring powering the first finger ring when the two finger rings are brought into contact with each other.

11. Novelty jewelry comprising:

a first jewelry item provided with an electrical display;

a second jewelry item;

at least one of the first and second jewelry items being provided with a source of electrical current;

wherein the first jewelry item is provided with a normally open circuit interconnecting the electrical display with the source of electrical current;

wherein the second jewelry item is provided with means to close the normally open circuit of the first jewelry item to cause operation of the electrical display of the first jewelry item when the second jewelry item is positioned adjacent the first jewelry item; and wherein the normally open circuit includes a magnetic switch, and wherein the means to close the normally open circuit includes a magnetic device which will cause the magnetic switch to be closed when the jewelry items are placed in juxtapositioned relationship.

12. Novelty jewelry comprising:

a first jewelry item provided with an electrical display;

a second jewelry item;

at least one of the first and second jewelry items being provided with a source of electrical current;

wherein the first jewelry item is provided with a normally open circuit interconnecting the electrical display with the source of electrical current;

wherein the second jewelry item is provided with means to close the normally open circuit of the first jewelry item to cause operation of the electrical display of the first jewelry item when the second jewelry item is positioned adjacent the first jewelry item; and wherein the first jewelry item includes a translucent element in the form of a colored "stone" mounted above the electrical display and wherein electrical display is a light source, which light source may illuminate the "stone" when the light source is operated.

13. The novelty jewelry as set forth in claim 12 wherein the first jewelry item is a first finger ring and the second jewelry item is a second finger ring, the second finger ring including a translucent element mounted above an electrical display, and wherein each electrical display is a light source, which light sources may illuminate the associated translucent element when the light sources are operated.

14. The novelty jewelry as set forth in claim 13 wherein the translucent elements of the first and second finger rings are of a matching color.

15. The novelty jewelry as set forth in claim 13 wherein each of the translucent elements has a message and/or image, which message and/or image is not normally visible, but which becomes visible when the light sources are operated.

* * * * *